US008435062B2

(12) United States Patent
Lange et al.

(10) Patent No.: US 8,435,062 B2
(45) Date of Patent: May 7, 2013

(54) LATCH ASSEMBLY FOR A CONNECTOR

(75) Inventors: Ludwig Lange, Nuland (NL); Ben Paagman, Schijndel (NL)

(73) Assignee: FCI, Guyancourt (FR)

( * ) Notice: Subject to any disclaimer, the term of this patent is extended or adjusted under 35 U.S.C. 154(b) by 193 days.

(21) Appl. No.: 12/998,358

(22) PCT Filed: Oct. 15, 2008

(86) PCT No.: PCT/IB2008/055337

§ 371 (c)(1),
(2), (4) Date: May 23, 2011

(87) PCT Pub. No.: WO2010/043933

PCT Pub. Date: Apr. 22, 2010

(65) Prior Publication Data

US 2011/0223794 A1 Sep. 15, 2011

(51) Int. Cl.
*H01R 13/627* (2006.01)

(52) U.S. Cl.
USPC ..... 439/350; 439/352

(58) Field of Classification Search ..... 439/350, 439/352, 353, 357, 483, 484
See application file for complete search history.

(56) References Cited

U.S. PATENT DOCUMENTS

| | | | | |
|---|---|---|---|---|
| 5,634,809 | A | 6/1997 | Hirai | 439/352 |
| 5,688,142 | A * | 11/1997 | Dietz et al. | 439/489 |
| 5,779,495 | A | 7/1998 | Dechelette et al. | 439/353 |
| 6,247,955 | B1 | 6/2001 | Yoshida et al. | 439/352 |
| 6,464,403 | B1 * | 10/2002 | Koch et al. | 385/53 |
| 6,716,052 | B2 * | 4/2004 | Kane | 439/352 |
| 7,318,740 | B1 | 1/2008 | Henry et al. | 439/352 |
| 2001/0046814 | A1 | 11/2001 | Tsuji et al. | 439/625 |
| 2004/0067676 | A1 * | 4/2004 | Nimura | 439/352 |
| 2007/0149030 | A1 * | 6/2007 | Kanamaru et al. | 439/352 |
| 2008/0081511 | A1 | 4/2008 | Lloyd et al. | 439/552 |

FOREIGN PATENT DOCUMENTS

| | | |
|---|---|---|
| EP | 0 026 703 | 11/1983 |
| EP | 0 951 102 A2 | 10/1999 |

* cited by examiner

*Primary Examiner* — Hae Moon Hyeon
(74) *Attorney, Agent, or Firm* — Harrington & Smith

(57) ABSTRACT

Latch assembly for latching two mating connectors. The latch assembly includes a main body and a resilient latch finger extending from the main body. The latch finger includes a locking section, such as a locking cam. A release member, e.g., a slider, is moveable between a locking position and a release position. The release member a pressure surface profiled to flex the latch finger away when the release member is moved to the release position. The pressure surface is positioned between the locking section and the connected end of the latch finger, when the release member is in the locking position. The main body can, e.g., include a surface with a sunk section, the latch finger forming an extension of the sunk section, while the release member is a slider slideable in the sunk section.

10 Claims, 10 Drawing Sheets

LATCH ASSEMBLY FOR A CONNECTOR

FIELD OF THE INVENTION

The present invention relates to a latch assembly for a connector, and in particular, an electrical cable connector. The invention also relates to a connector comprising such a latch assembly.

BACKGROUND OF THE INVENTION

After plugging a cable connector into a mating receptacle unit, unintentional disconnection can result in disruption of transmission of data or electrical power. To prevent unintentional disconnection, it has been proposed to use a latch finger releasable by pulling a slideable cover. To pull the slideable cover, a user must be able to reach the slideable cover to grip it. This can be difficult with small sized connectors or with systems having a plurality of connectors to be plugged in side by side at short mutual distance.

SUMMARY OF THE INVENTION

It is an object of the invention to provide a compact releasable latch assembly for a connector, which is easy to actuate.

To this end, the invention provides a latch assembly according to claim 1.

This way, a compact and robust latch assembly is obtained. An effective lock and release mechanism is provided while the volume of the connector can still be minimized. The locking section can for example be a locking cam or notch.

To obtain a very compact construction, the main body comprises a surface with a sunk section, the latch finger forming an extension of the sunk section.

The release member is a slider which is slideable within the sunk section. The slider advantageously flushes with the main body of the latch assembly to achieve a low profile, thin latchable connector assembly.

The slider comprises one end projecting from the housing of a latched connector at a side opposite the mating side of the connector. This side is easily accessible by a user. Optionally, the projecting end of the slider comprises a grip opening, or a handle or hook or the like to provide an easier and better grip.

According to an embodiment, the main body is made integral part of a connector housing, for instance a cover shell of the connector housing. The housing comprises two mating shells connected by a fastening means at a point within the sunk section in line with a longitudinal axis of the latch finger.

The release member comprises a surface facing the latch finger, the surface comprising a recess cooperating with a corresponding bulge on the latch finger wherein the bulge has a light slope towards the free end of the latch finger and a steep slope towards the fixed end of the latch finger. Alternatively, the surface of the release member comprises a bulge cooperating with a recess in the latch finger wherein the bulge has a light slope towards the free end of the latch finger and a steep slope towards the fixed end of the latch finger.

The movement of the release member is limited by a stop, defining the release position. As a result, further pulling the slider will pull the connector as a whole and disconnect it from the receptacle connector or board connector. This way, the connector is released and disconnected by a single movement of the user.

To this end, the sunk section is provided with recesses in its side walls, for slidingly engaging lateral projections extending along a part of the sides of a sliding cover, wherein the recesses comprise an end stop defining the release position.

The latch assembly is provided with a mounting section for mounting the assembly onto a connector housing, e.g., by means of a snap joint.

The invention also relates to a connector comprising a latch assembly as described above. Such a connector for instance comprises a housing built of two or more shells connected by a fastening means at a point within the sunk section in line with the longitudinal direction of the latch finger. This way, the fastening means can be covered by the release member.

BRIEF DESCRIPTION OF THE DRAWINGS

The present invention will be understood with reference to the figures wherein.

DETAILED DESCRIPTION OF EMBODIMENTS

Figure 1:
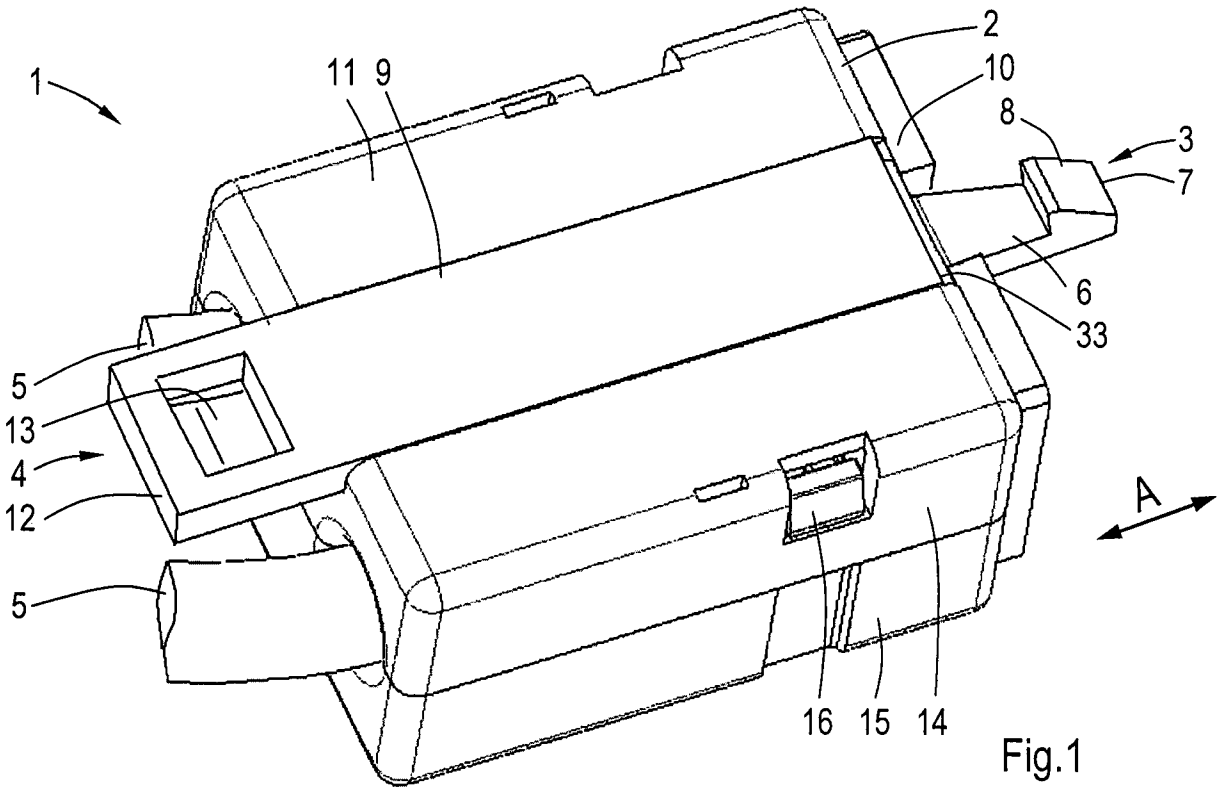
FIG. 1: shows a connector according to the present invention.

FIG. 1 shows a connector 1 comprising an insulating connector housing 2, e.g., made of a plastic material, with a mating side 3 and a cable inlet side 4 for attachment of the connector 1 to two cables 5. The connector 1 is designed to mate with a complementary connector by exerting a force in a mating direction corresponding to the direction of arrow A in the drawing.

The insulating housing 2 forms the main body of a latch assembly comprising a resilient latch finger 6 as an integral part of the housing 2. The latch finger 6 has an outer end 7 with a locking section formed by a locking cam 8. The latch finger 6 projects from the mating side 3 of the housing 2.

A release member 9 is formed by a slider which can be slid between a locking position and a release position in a direction corresponding to the mating direction A. The slider 9 is received in a sunk section or recess 10 so that it flushes with the surface 11 of the connector 1 (the top surface for the illustrated connector). The slider 9 has one outer end 12 projecting from the cable inlet side and provided with an opening 13 to enable a user to pull the slider 9, e.g., with a finger or a screw driver. In the release position, the outer end 12 of the slider 9 projects further from the cable inlet side 4 than in the locking position. As a result, a user can immediately see whether the slider 9 is in the locking position or in the release position and whether the connector is locked or unlocked.

The housing 2 comprises an upper shell 14 and a lower shell attached to each other by a snap joint 16, and by fastening means covered by the slider 9. The latch finger 6 is moulded in one single piece with the upper shell 14. The latch finger 6 is an integral part of the upper shell 14.

Figure 3:
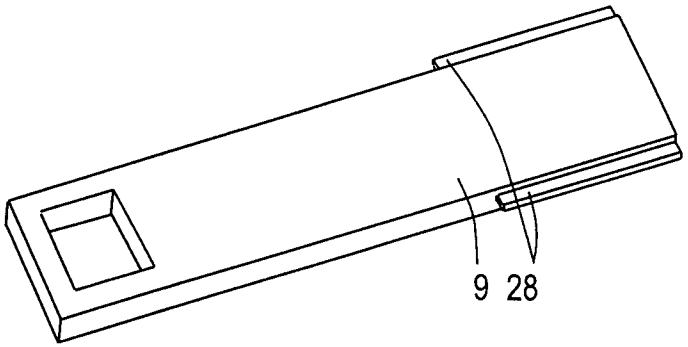
FIG. 3: shows the slider of the connector of FIG. 1.
Figure 2:
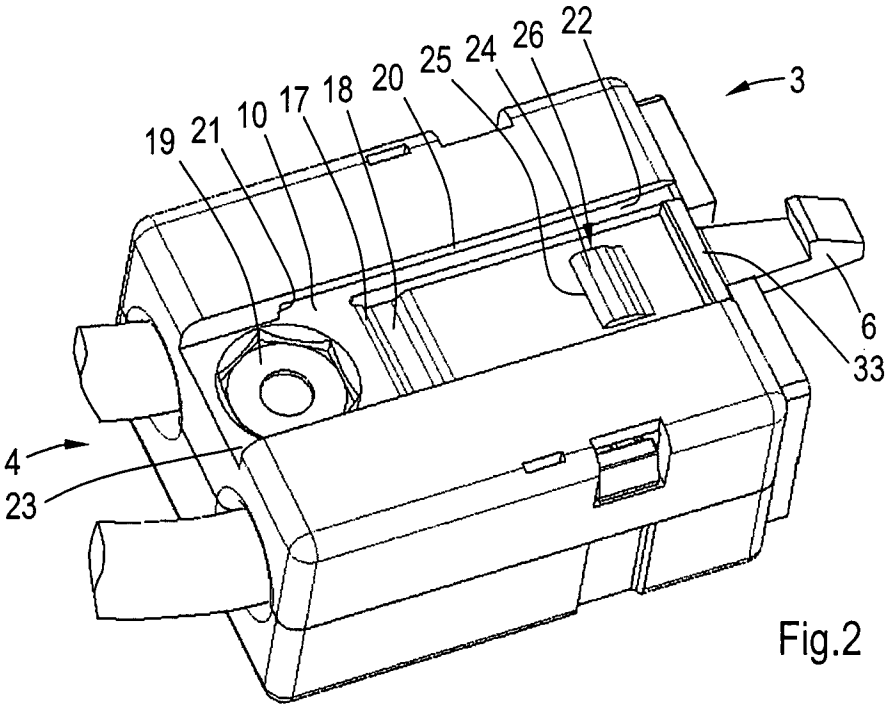
FIG. 2: shows the connector of FIG. 1 without the slider.

FIG. 2 shows the recess 10 in the connector 1 without the slider 9. The cantilevered latch finger 6 has one connected end 17 bridging it to the rest of the upper shell 14 of the housing 2. Near the base section 17, the latch finger 6 is provided with a section 18 of reduced thickness extending in a direction substantially perpendicular to the longitudinal axis of the latch finger 6. The section 18 of reduced thickness forms a resilient bridge or film hinge between the latch finger 6 and the rest of the upper shell 14. This way, the latch finger 6 forms a spring. In the rest position, as shown in FIG. 2, the latch finger is parallel to the slider 9. When the slider 9 is moved to the release position, the latch finger 6 is flexed (downwardly with regard to FIG. 2 orientations), as further described here below. Between the fixed end 17 of the latch finger 6 and the cable inlet end 4 of the connector 1 is a fastening screw 19 sunk in the surface of the connector housing 2. The recess 10 has two side walls 20, 21. In the side walls 20, 21 is a slot (or groove) 22 extending from the mating side 3 of the connector 1 to a stop 23 near the fastening means 19. Both side walls 20, 21 are symmetrically provided with such a slot 22. These slots or grooves 22 form a guiding means for corresponding side projections 28 on the slider 9, as shown in FIG. 3. Near the mating side 3 of the connector 1, on its side facing the slider 9 the latch finger 6 is provided with a bulge 24 with a steep slope side 25 in the direction of the fixed end 17 of the latch finger 6, and with a gentle slope side 26 in the direction of the mating side 3 of the connector 1.

Figure 4:
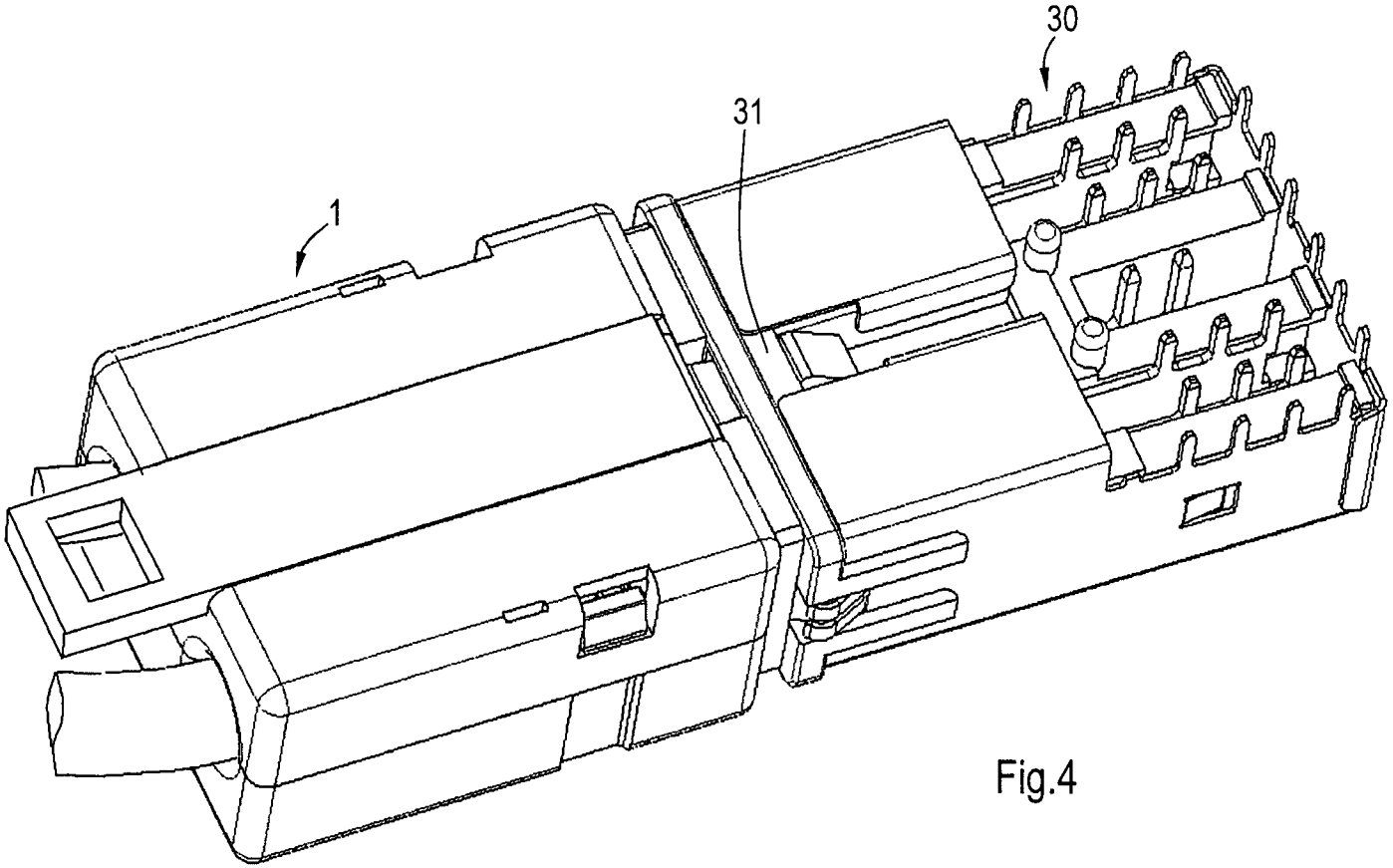
FIG. 4: shows the connector of FIG. 1 connected to a corresponding receptacle connector.
Figure 5:
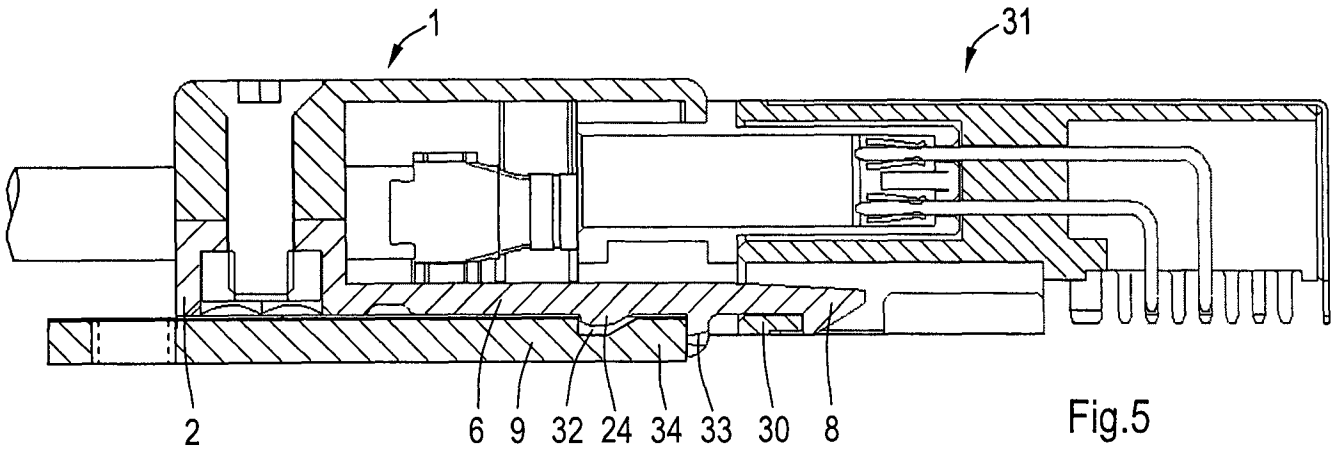
FIG. 5: show in cross section the connector of FIG. 1 connected to a corresponding receptacle connector.

In FIG. 4, the connector 1 is connected to a corresponding receptacle connector 30. The cam 8 of latch finger 6 hooks behind a stop 31 provided on the receptacle connector to fixate the connector 1 to receptacle connector 30, as shown in cross section in FIG. 5. In FIG. 5, the slider 9 is in the locking position, while in FIG. 6 the slider 9 is in the release position. On its surface facing the latch finger 6 the slider 9 is provided with a pressure surface 34 with a recess 32 receiving the bulge 24 on the latch finger 6. The recess 32 slopes gently in the direction of the mating side of the connector 1, so that it can slide easily over the gently sloping side 26 of the bulge 24 when the slider 9 is pulled to the release position. The latch finger 6 is provided with a stop 33 abutting the end of the slider 9 when it is pushed in the locking position.

Figure 6:
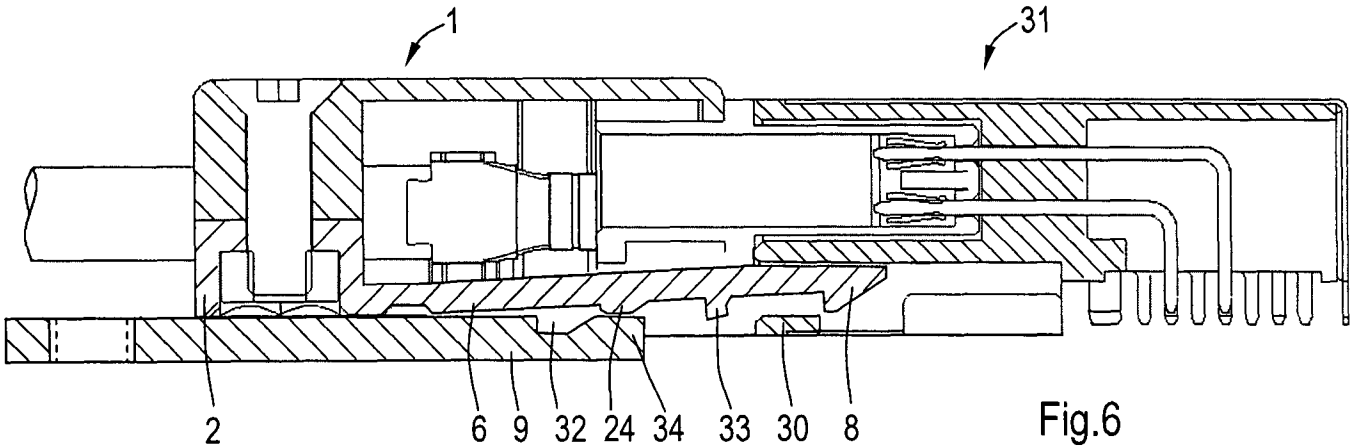
FIG. 6: shows in cross section the connector and receptacle connector of FIG. 5 with a retracted slider.

As shown in FIG. 6, pulling the slider 9 to the release position moves the bulge 24 on the latch finger 6 out off the recess 32 of the slider 9. Pressure surface 34 at the outer end 34 of slider 9 presses bulge 24 inwardly and moves the locking cam 8 away from the stop 31 of the receptacle connector 30. In this position, the side projections of slider 9 abut the stops 23 in the side walls 20, 21 of recess 10. As a result, further pulling the slider 9 pulls the connector 1 away from the receptacle connector 30. Consequently, in one single pulling movement, the slider unlocks the latch finger 6 and pulls out the connector 1 from the corresponding receptacle connector 30.

Figure 7:
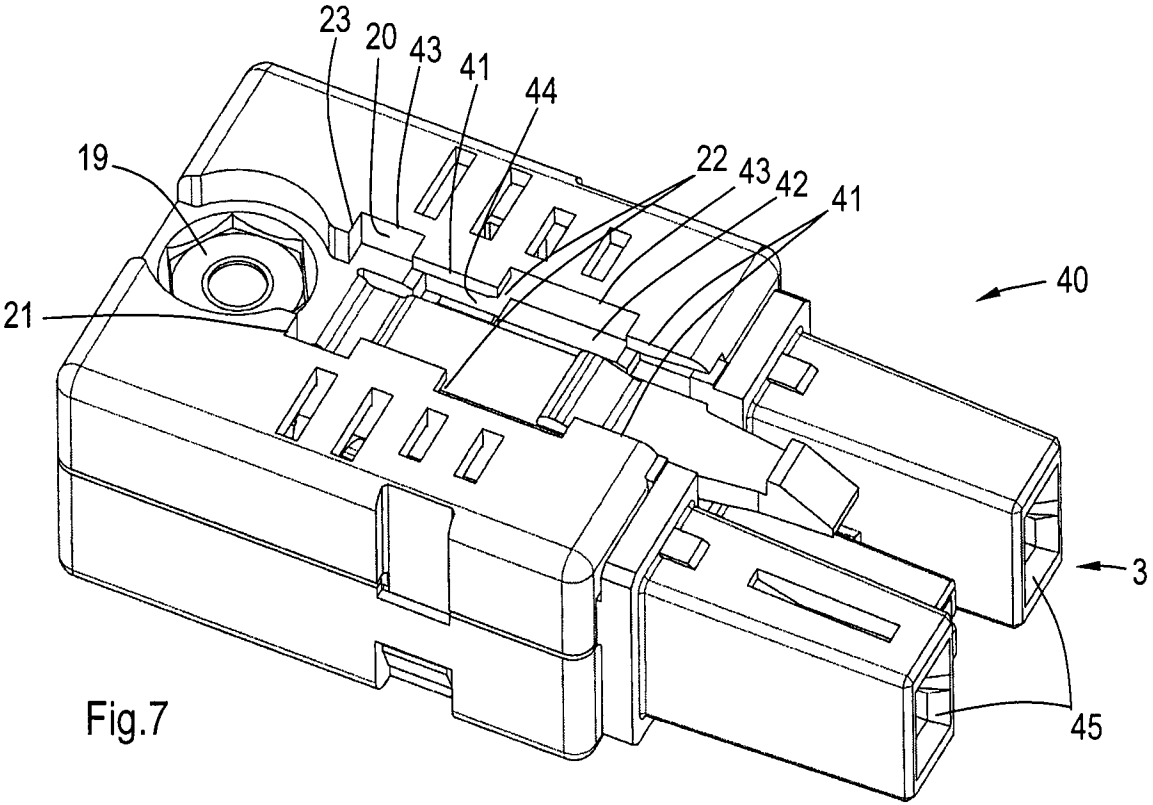
FIG. 7: shows in perspective view of further possible embodiment of a connector according to the present invention.

FIG. 7 shows a further embodiment of a connector 40 according to the present invention. The connector 40 is similar to the connector shown in FIGS. 1-6. Same parts are referred to by the same referential numbers. Similar as in FIG. 2, a slot 22 is provided in the side walls 20, 21. The slot 22 extends from the mating side 3 of the connector 1 to a stop 23 near the fastening means 19. Both side walls 20, 21 are symmetrically provided with such a slot 22. These slots 22 form a guiding means for corresponding side projections 28 on the slider 9 (see FIG. 3). The slots 22 are bordered by an upper guiding rib 41 and a lower guiding surface 42. The guiding rib 41 and lower guiding surface 42 are provided with staggeredly arranged interruptions 43, 44. This way a simplified mould can be used to manufacture the housing, e.g., by injection moulding. At its mating side 3, the connector 40 is further provided with guiding buses 45 for guiding electroconductive contact leads of a mating receptacle.

Figure 8:
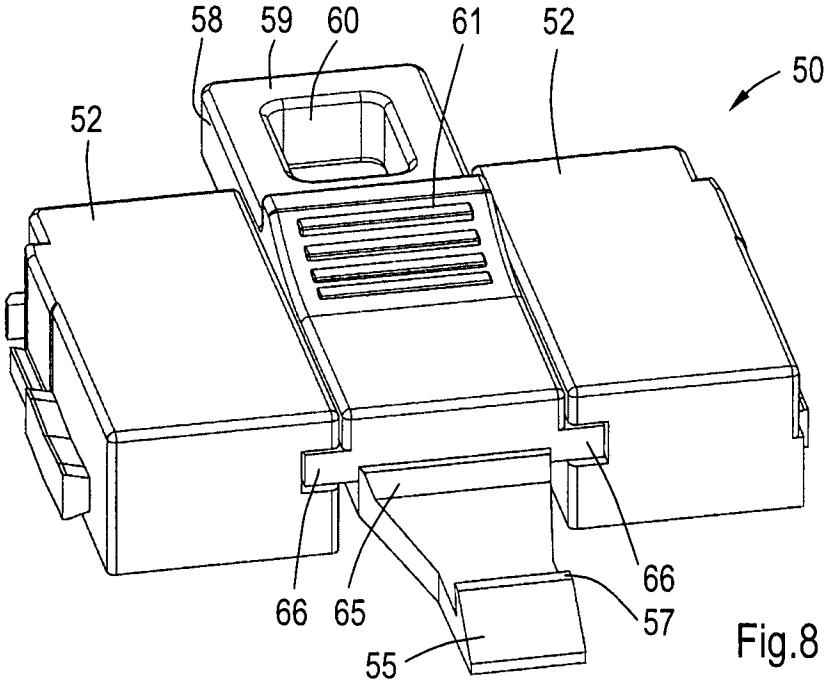
FIG. 8: shows in perspective view a further possible latch assembly according to the present invention.
Figure 9:
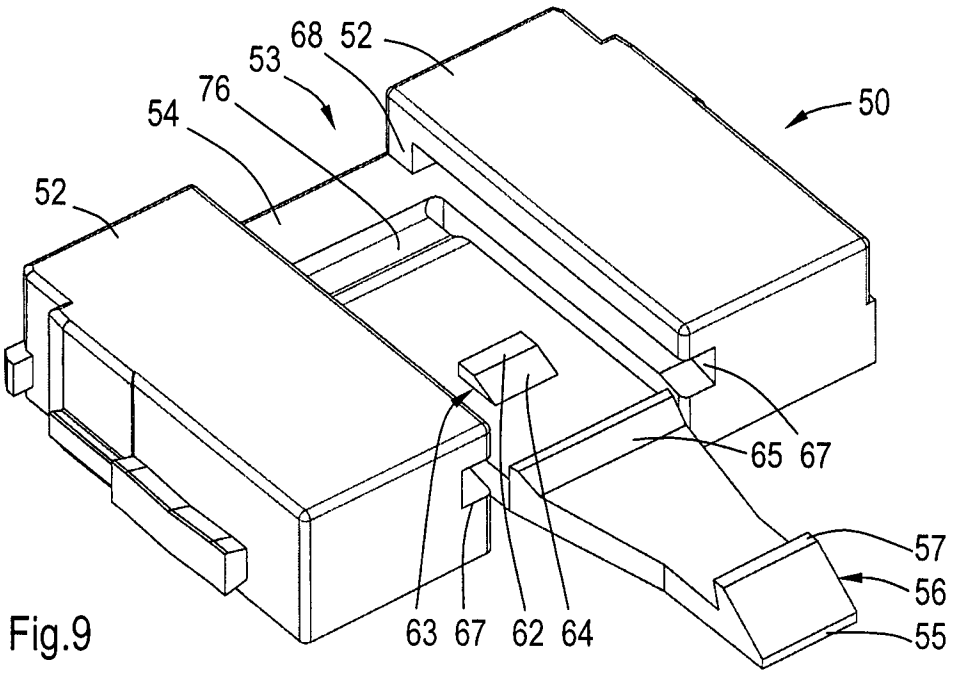
FIG. 9: shows the assembly of FIG. 8 without release slider.
Figure 10:
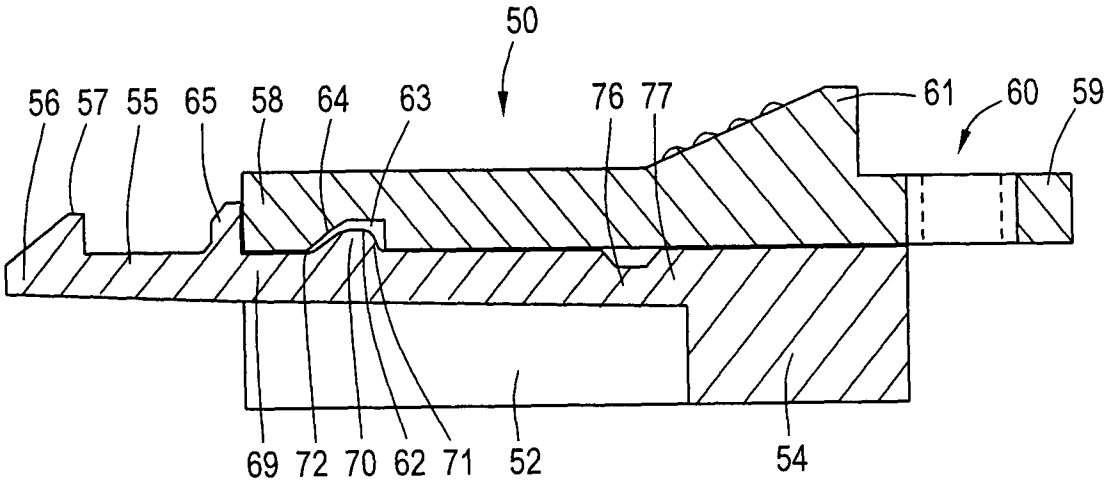
FIG. 10: shows the assembly of FIG. 8 in cross section.
Figure 11:
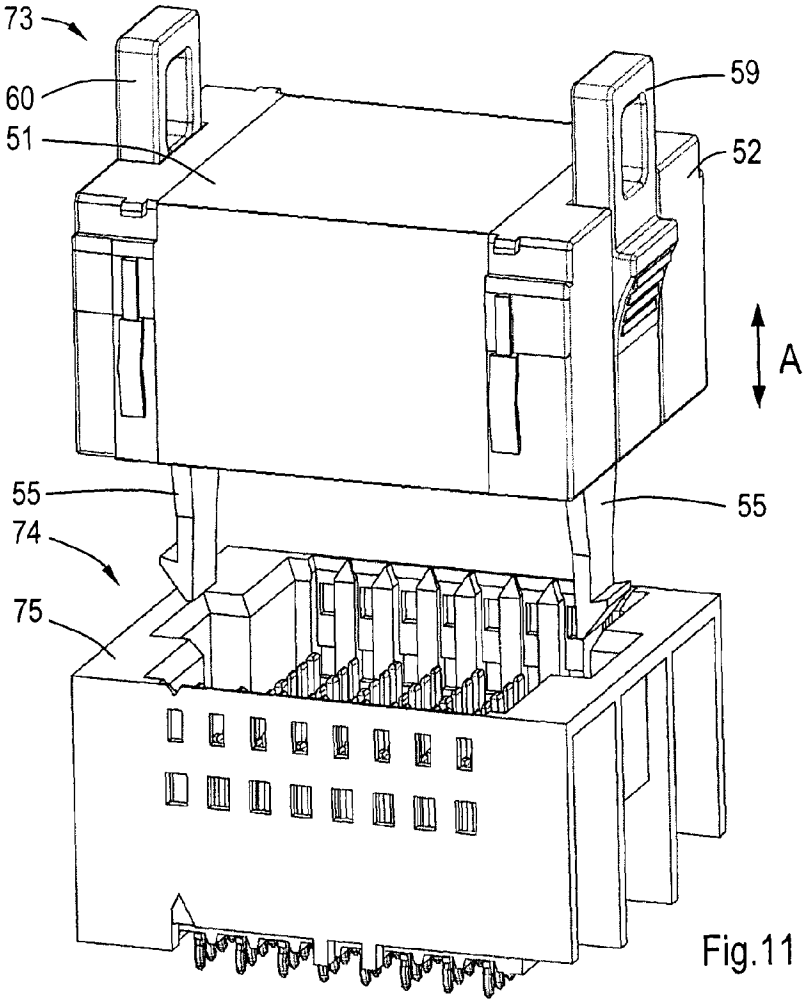
FIG. 11: shows two latch assemblies as shown in FIG. 8 fixating two mating connectors.

FIG. 8 shows a latch assembly 50 according to the present invention. The same latch assembly is shown without slider in FIG. 9, and is shown in cross section in FIG. 10. The assembly 50 is clicked upon a side wall of a connector housing, as shown in FIG. 11, showing a connector housing 51 sandwiched between two such latch assemblies 50 to form a latchable connector. The latch assembly 50 comprises a main body with two rectangular side sections 52 bridged by a sunk central section 53. As can be seen in FIG. 9, the sunk section 53 comprises a bridge section 54 between the side sections 52 and a resilient latch finger 55 extending from the bridge section 54 in a direction between the side sections 52. The resilient latch finger 55 has one end 76 connected to the bridge section 54 and an outer end 56 with a locking section formed by the locking cam 57.

A release member 58 is formed by a slider which is slid between a locking position and a release position. In FIG. 8, the assembly 50 is shown with the release member 58 in the locking position. The slider 58 is positioned in the sunk section 53 in such way that it is flush with the top surface of the side sections 52. The slider 58 has one outer end 59 projecting from the assembly 50. The outer end 59 is provided with an opening 60 to enable a user to pull the slider 58. In the release position, the outer end 59 of the slider 58 projects further from the assembly 50 than in the locking position. As a result, a user can immediately see whether the slider 58 is in the locking position or in the release position and whether the connector is locked or unlocked.

On its top surface, the slider 58 is provided with a ribbed protuberance 61 providing additional grip for a user for moving the slider 58 between the locking position and the release position.

As shown in FIG. 9, the latch finger 55 is provided with a bulge 62 on its side facing the slider 58. The bulge 62 has a steep side 63 in the direction of the bridge section 54, and a gentle slope side 64 in the direction of the locking cam 57. The latch finger 55 also comprises a stop 65 abutting the end of the slider 58 when the slider 58 is in the locking position.

As shown in FIG. 8, the slider 58 has two lateral ribs 66 slideably engaging corresponding grooves 67 in the side sections 52 of the assembly 50 to guide the slider 58 when it is moved between the locking position and the release position. A stop 68 in the grooves 67 (see FIG. 9) defines the end of the movement of the slider 58 corresponding to the release position.

The side of slider 58 facing the latch finger 55 forms a pressure surface 69 profiled to push on the latch finger 55 when the slider 58 is moved to the release position. The pressure surface 69 of slider 58 is provided with a recess 70 for receiving the bulge 62 on the latch finger 55 when the slider 58 is in the locking position. The recess 70 has one side 71 with a steep slope facing the steep slope 63 of bulge 62, and one side with a gentle slope 72 facing the gentle slope side 64 of the bulge 62.

As shown in FIG. 11, two assemblies 50 according to FIG. 8 can be mounted onto opposite sides of the connector housing 51 via a coupling piece (not shown) adapted to cooperate with both the latch assemblies and the connector. The connector 73 is dimensioned to mate with a corresponding receptacle connector 74, by pushing the two connectors together in a mating direction, indicated in the drawing by arrow A. The receptacle connector 74 comprises a housing 75 of an electroisolative material. When the connector 73 is brought into mating engagement with the connector 74 both latch fingers 55 engage a corresponding recess in the interior of housing 75 to form a snap joint.

To release the connector 73, a user can pull the slider 58 to move it into the release position. The slider 58 moves away from the stop 65 on the latch finger 55. The bulge 62 slides out off the recess 70. Passing the gently sloping side 72 of the recess 70, the bulge 62 is gradually pushed by the pressure surface 69 of the slider 58. When the bulge 62 is completely moved out of the recess 70, the lateral ribs 66 abut the stop in the corresponding recess 67 defining the release position. The latch finger 55 is now pushed away and the locking cam 57 is no longer latching in the corresponding recess in the interior of housing 75 of the receptacle connector 74. Further pulling the slider 58 pulls the latch fingers 55 out of the receptacle connector 74 and disconnects both connectors 73, 74.

At short distance from the bridge section 54, the latch finger 55 is provided with a section of reduced thickness 76. When the latch finger 55 is pushed away by the pressure surface 69 of the slider 58, the latch finger 55 flexes around this section 76 which acts like a film hinge, while the rest of the latch finger 55 remains more or less undeformed.

The invention claimed is:

1. A latch assembly for latching two complementary connectors which can be brought into mating engagement and disengagement respectively, by a force in a mating direction, the latch assembly comprising:

a main body;

a resilient latch finger extending from the main body, the latch finger comprising a locking section and one end connected to the main body;

a release member moveable in the mating direction between a locking position and a release position, the release member being provided with a pressure surface profiled to flex the latch finger away from the release member when the release member is moved to the release position;

wherein the pressure surface is positioned between the locking section and the connected end of the latch finger, when the release member is in the locking position characterized in that the main body comprises a surface with a sunk section and in that the latch finger forms an extension of the sunk section.

2. The latch assembly according to claim 1, wherein the release member is a slider which is slideable in the sunk section.

3. The latch assembly according to claim 2 wherein the slider is flush with the main body.

4. The latch assembly according to claim 2 wherein the slider comprises one end which, when connected to a latched one of the complementary connectors, is configured to project from a housing of the latched connector at a side opposite a mating side of the latched connector.

5. The latch assembly according to claim 4 wherein the projecting end of the slider comprises a grip opening.

6. The latch assembly according to claim 1 wherein the release member comprises a surface facing the latch finger, the surface comprising a recess cooperating with a corresponding bulge on the latch finger wherein the bulge has a light slope towards the free end of the latch finger and a steep slope towards the fixed end of the latch finger.

7. The latch assembly according to claim 1 wherein the sunk section is provided with recesses in its side walls, for slidingly engaging lateral projections extending along a part of the sides of the release member, wherein one or more of the recesses comprise an end stop defining the release position.

8. The latch assembly according to claim 1 wherein the assembly comprises a mounting section for mounting the assembly on a connector.

9. A connector comprising the latch assembly according to claim 1.

10. The connector according to claim 9 wherein the connector comprises a housing comprising two mating shells connected by a fastening means at a point within the sunk section in line with a longitudinal axis of the latch finger.

* * * * *